US009074316B2

(12) United States Patent
Deschietere et al.

(10) Patent No.: US 9,074,316 B2
(45) Date of Patent: Jul. 7, 2015

(54) METHOD FOR FIREPROOFING TEXTILES

(75) Inventors: Johan Deschietere, Lovendegem (BE); Luc Carlier, Waregem (BE)

(73) Assignee: CTF 2000 NV, Zele (BE)

( * ) Notice: Subject to any disclaimer, the term of this patent is extended or adjusted under 35 U.S.C. 154(b) by 30 days.

(21) Appl. No.: 14/117,614

(22) PCT Filed: Apr. 26, 2012

(86) PCT No.: PCT/EP2012/057627
§ 371 (c)(1), (2), (4) Date: Nov. 13, 2013

(87) PCT Pub. No.: WO2012/156190
PCT Pub. Date: Nov. 22, 2012

(65) Prior Publication Data

US 2015/0056374 A1 Feb. 26, 2015

(30) Foreign Application Priority Data

May 17, 2011 (EP) ..... 11166319

(51) Int. Cl.

| | |
|---|---|
| ***D06M 13/342*** | (2006.01) |
| ***D06M 13/432*** | (2006.01) |
| ***D06M 13/12*** | (2006.01) |
| ***D06M 13/256*** | (2006.01) |
| ***D06M 13/272*** | (2006.01) |
| ***D06M 13/282*** | (2006.01) |
| ***D06M 13/285*** | (2006.01) |
| ***D06M 13/392*** | (2006.01) |
| ***D06M 13/41*** | (2006.01) |
| ***D06M 13/422*** | (2006.01) |
| ***D06M 15/43*** | (2006.01) |
| ***D06M 15/431*** | (2006.01) |
| ***D06M 15/667*** | (2006.01) |
| ***D06M 15/673*** | (2006.01) |
| ***D06M 11/50*** | (2006.01) |
| ***D06M 13/53*** | (2006.01) |

(52) U.S. Cl.
CPC ..... *D06M 13/432* (2013.01); *D06M 13/12* (2013.01); *D06M 13/256* (2013.01); *D06M 13/272* (2013.01); *D06M 13/282* (2013.01); *D06M 13/285* (2013.01); *D06M 13/392* (2013.01); *D06M 13/41* (2013.01); *D06M 13/422* (2013.01); *D06M 15/43* (2013.01); *D06M 15/431* (2013.01); *D06M 15/667* (2013.01); *D06M 15/673* (2013.01); *D06M 2200/30* (2013.01); *D06M 11/50* (2013.01); *D06M 13/53* (2013.01)

(58) Field of Classification Search
None
See application file for complete search history.

(56) References Cited

U.S. PATENT DOCUMENTS

| | | | | |
|---|---|---|---|---|
| 4,076,650 | A * | 2/1978 | McDonald | 502/218 |
| 4,750,911 | A | 6/1988 | Hansen et al. | |
| 4,765,796 | A | 8/1988 | Harper, Jr. et al. | |
| 4,842,609 | A | 6/1989 | Johnson | |
| 6,869,996 | B1 | 3/2005 | Krajnik et al. | |
| 2011/0092119 | A1 | 4/2011 | Cliver et al. | |
| 2011/0281097 | A1 * | 11/2011 | Li et al. | 428/219 |

FOREIGN PATENT DOCUMENTS

| | | |
|---|---|---|
| GB | 1453296 A | 10/1976 |

OTHER PUBLICATIONS

European Patent Office, International Search Report in International Patent Application No. PCT/EP2012/057627 (Aug. 7, 2012).

* cited by examiner

*Primary Examiner* — Erma Cameron
(74) *Attorney, Agent, or Firm* — Leydig, Voit & Mayer; Gerald T. Gray

(57) ABSTRACT

This invention relates to a method for fireproofing textiles based on a composition having two components comprising:

a component A comprising at least one phosphorous compound; and a component B comprising urea and at least one pH buffer, optionally with an oxidizing agent.

Said method for fireproofing textiles includes the steps of immersing said textiles in said composition, and of heating, oxidizing and then washing said textiles, which then have excellent human-ecological, comfort, and durable fireproofing properties.

13 Claims, No Drawings

METHOD FOR FIREPROOFING TEXTILES

CROSS-REFERENCE TO RELATED APPLICATIONS

This patent application is the U.S. national phase of International Application No. PCT/EP2012/057627, filed on Apr. 26, 2012, which claims the benefit of European Patent Application No. 11166319.1, filed May 17, 2011, the disclosures of which are incorporated by reference.

FIELD OF THE INVENTION

This invention relates to a method for fireproofing textiles, as well as the fireproofed textiles thus obtained.

INTRODUCTION

Fireproofing textiles is a well-known technique today and is used in very many fields where it is sought to have textiles (clothing (for work), fabrics, canvasses, and others) comprising natural and/or synthetic fibres that are flame-resistant, i.e. hardly flammable, or even non-flammable.

However, none of the treatments proposed to date is fully satisfactory for the end consumer, as the treated textiles have properties that are not adapted to the market. Users want fireproofed textiles that are washproof, comfortable to wear, that have durable fireproofing, and that are non-toxic for the body and the environment. In this regard, they must comply with human-ecological standards such as Oeko-Tex 100 Class 1.

PRIOR ART

Textile fireproofing treatments that make use of immersion bath compositions comprising a phosphorous compound and urea are known in the art.

U.S. Pat. No. 4,765,796, for example, relates to a fireproofing treatment of a dyed textile, in particular cotton, including a step of immersion in a bath containing a tetrakis(hydroxymethyl)phosphonium salt (THPx) and urea, followed by polymerisation, neutralisation and oxidation, and washing and drying steps. Documents GB 1 453 296, U.S. Pat. No. 4,842,609 and U.S. Pat. No. 4,750,911 cover similar treatments that can be applied to textiles made of polyester, cotton/polyester and cotton/nylon, respectively.

US 2011/0092119 relates to an analogous fireproofing treatment of textiles made of satin, wherein use is made in particular of hydrazide in order to reduce the free formaldehyde content.

These treatments do not provide the textile with sufficient resistance to washing, which requires a substantial impregnation rate in order to meet the fireproofing tests carried out after multiple washings.

This substantial impregnation rate unfortunately results in a lack of aesthetics and comfort of the treated textiles, which are very rigid to the touch and therefore do not enable substantial freedom of movement, which is particularly disadvantageous for work clothing due to the impact on productivity.

Consequently, the need remains with regards to a method for fireproofing textiles that makes it possible to obtain finished products that have human-ecological, aesthetic, comfort, and durable fireproofing qualities.

SUMMARY OF THE INVENTION

A first object of the invention is to procure a fireproofing treatment adapted to any type of textiles, which makes it possible to optimise the quality thereof simultaneously from the standpoint of aesthetics, feel and resistance to washing.

Another object of the invention aims to procure a fireproofing treatment for any type of textile, which is simple to implement, without, or with very little release of irritating and toxic bad odours (due to the formaldehyde), during the treatment itself as well as in the finished product.

Further objects shall appear in the following description de this invention.

It has now been discovered that these objects have been achieved, entirely or at least in part, thanks to the method for fireproofing textiles according to this invention.

As such, the subject matter of the invention consists in a method for fireproofing textiles comprising at least the followings steps:

a) preparation of a first bath comprising a composition with two components A and B, with component A comprising at least one phosphorous compound and component B comprising urea and at least one pH buffer;

b) impregnation of the textile to be treated in the bath obtained in step a) of which the pH is between 3.5 and 6;

c) heat-drying of the impregnated textile, during which drying the polymerisation reaction of the urea of component B and the phosphorous compound of component A occurs;

d) stabilisation and neutralisation via an oxidation reaction of the polymer obtained in step c) in a second bath;

e) washing in water and drying of the treated textile; and f) recovery of the fireproofed textile.

According to the invention, the second bath includes, in addition to at least one oxidizing compound, a mixture of diacetone acrylamide and of at least one organic acid dihydrazide.

This mixture crosslinks the phosphorous compound/urea polymer on the textile. Moreover, the oxidation in steps c) (due to the increase in the pH following the breakdown of the urea into ammonia) and d) of the phosphorous of the aforementioned polymer increases insolubility thereof.

Consequently, the cross-linking mixture contributes to a better fixation of the polymer on the textile, and therefore, with the aforementioned oxidation, to an excellent resistance to washing. At the same time, it substantially reduces the free formaldehyde content that can evaporate from the fireproofed textiles and therefore irritate and poison the users of same.

On the other hand, the excellent resistance to washing of the fireproofed textiles according to the method of the invention makes it possible to reduce the impregnation rate thereof, which is beneficial for the feel (to one's hand) and therefore for the comfort of the user, and/or to extend the fireproofed nature of same and therefore the useful life thereof.

DESCRIPTION OF PARTICULAR EMBODIMENTS

The main constituent of component A is chosen from among phosphorous compounds known for their fireproofing properties, and more particularly chosen from among phosphates, phosphines, phosphinates and phosphonium salts. Among the phosphonium salts, tetrakis(hydroxymethyl) phosphonium salts are preferred, known under the generic name of THPx, and in particular THPS (THP sulphate), THPC (THP chloride), THPP (THP phosphate), and others such as THPS-Urea, THPC-Urea, etc. THPS in particular is preferred.

In the description of this invention, the term "compatible" means "non-reactable" and stable, under the conditions of use according to the invention".

The components A and B can optionally include one or more anti-odour agents, which, where applicable, are capable of absorbing or masking the odour of the phosphorous compound described hereinabove. Indeed, certain phosphorous compounds, THPx in particular, very often have a very unpleasant odour, and it is not uncommon for them to cause headaches and severe irritations in persons who work with these products without specific protection.

The anti-odour agents can be chosen from among commonly used odorising agents that cover up (odour absorbents or maskants or the like) and that are compatible with components A and B. In particular, the anti-odour agent or agents are chosen from among those which are stable in component A, inert with regards to components A and B, and resistant at working temperature, i.e. during the textile treatment method described further on in this description.

Alternatively, the use of phosphorous compounds can be considered, and THPx in particular, more particularly a THPS, which are prepared according to selective methods, thereby enabling phosphorous compounds of high purity to be obtained, which contain very little or no impurities and by-products, which are responsible for the bad odours that are usually associated with said phosphorous compounds. A THPx produced by means of a method operating without excess formaldehyde is preferably used.

When such high-purity phosphorous compounds are used, the adding of an anti-odour agent is not necessary. However, one or more anti-odour agents can be added, along with the high-purity phosphorous compounds described hereinabove, in order to provide component A with a pleasant odour, if desired or required for the anticipated use.

The quantity of the anti-odour agent or agents used can vary within substantial proportions according to the sought-after effect, the nature of the anti-odour agent or agents and the nature and quantity of the compound or compounds present in component A. Generally, this quantity varies from a few ppm by weight to a few percentage points by weight, typically from 1 ppm by weight to 10% by weight, more preferably from 5 ppm by weight a 5% by weight, preferably from 10 ppm to 3% by weight, and more preferably from 100 ppm by weight to 2% by weight in relation to the total weight of component A.

Component A can be prepared according to any method known per se, and generally by simple intermixing of the various compounds of component A, in any order whatsoever.

As indicated previously, component B includes urea ($H_2N(C{=}O)NH_2$) and at least one pH buffer, i.e., a compound enabling the pH of the first bath to be controlled and maintained at a value between 3.5 and 6, advantageously at a value between 3.5 and 5.5.

The pH buffer can be chosen from among the pH buffers known by those skilled in the art, with the understanding that it is compatible with urea and inert with regards thereto. By way of non-limiting examples, the pH buffers that can be used are advantageously chosen from among the ammonia phosphates, ammonia chlorides, ammonia sulphates, and ammonia carbonates, and the mixtures thereof, with a preference for ammonia phosphate. These pH buffers can also be used in combination/mixture with one or more acids chosen from among phosphoric acid, sulphuric acid, citric acid, maleic acid and others in order to precisely adjust the pH to the value required for the method according to the invention.

Without wanting to be bound by theory, the pH buffer enables the pH to be fixed, but also and above all acts as a "catalyst" for breaking down the urea into ammonia, this breakdown giving rise, via the increase of the pH, as indicated hereinabove, to a preliminary oxidation of the polymer during the drying step c).

The component B comprises, optionally but advantageously, at least one oxidising agent, preferably chosen from among the nitrogen compounds, and even more preferably, from among the nitro-aryls, and, by way of a non-limiting example, the oxidising agent is 3-Nitrobenzenesulfonic acid sodium salt. In the oven, this oxidising agent causes oxidation of the polymer in addition to that which occurs in step c) following the breakdown of the urea into ammonia, as well as the maintaining of this last oxidation when the textile is on hold in the dry state before undergoing the final oxidation in the second bath. The action of this oxidising agent contributes in maximising the oxidation of the polymer, and therefore the resistance to washing of the fireproofed textile and the useful life thereof.

The quantity of oxidising agent can vary in substantial proportions and is generally fixed at an oxidant/urea weight ratio between 1/2 and 1/4, and advantageously approximately 1/3.

Component B can also include various other additives, fillers, anti-odour agents, softeners, rheology agents, viscosity agents, foaming agents, anti-foaming agents, stabilisers, and others, as well as one or more fireproofing or flame-retardant agents.

The composition having two components A and B, as defined hereinabove, can be in the form of two separate components, which will be mixed immediately before use. Alternatively, the bicomponent composition can be in the form of a ready-to-use solution comprising the two components A and B.

The bicomponent composition comprising the components A and B, as they have just been defined, in a separate or mixed form, have a particularly appropriate use in the fireproofing treatment of textiles.

The textiles that can receive the fireproofing treatment with the bicomponent composition according to this invention can be of any type, and in particular textiles with a natural fibre base, whether they are plant or animal (cotton, linen, wool, and others), and/or with a synthetic fibre base, as for example fibres with a polyester, polyamide 6 and 6.6 base, and others. Textiles with a cotton base, with a cotton/polyester base, and with a cotton/polyamide base are preferred, and among these those of which the weight per square meter is between about 100 g/m$^2$ and about 600 g/m$^2$.

The textiles that can be subjected to the fireproofing treatment according to this invention can be at any step of their manufacture, i.e. they can be subjected to the fireproofing treatment when they are in the form of sewn or knitted textiles, before or after dyeing, or in the form of textiles that have already been subjected to one or more finishing treatments.

According to an embodiment of the invention, the component B used for the fireproofing treatment according to this invention will be adapted according to the nature of the fibres that comprise the textile, for example according to whether this textile is made of cotton or of fibres with a polyester/cotton blend.

The first bath (step a) is prepared by simple mixing of component A and component B (or by using the ready-to-use mixture of components A and B). The component A/component B weight ratio can vary in substantial proportions, in particular according to the nature of the phosphorous compound. This ratio is adjusted in such a way as to be able to form a polymer between the phosphorous compound of component A and the urea of component B.

The first bath can further include a textile softener, which can have the role of a processing aid. The textile softener can be of any type known to those skilled in the art and advantageously chosen from among the fatty acids, silicone emulsions, silicone microemulsions, and polysiloxanes including Addisoft®, marketed by CTF 2000. The latter reacts with the textile as well as with the polymer so as to provide the coated textile with qualities of flexibility and therefore comfort for the user. Furthermore, in light of its hydrophilic nature, in the oxidation step d), it promotes the reaction with hydrogen peroxide and consequently improves the washproofness of the fireproofed textile by means of this oxidising compound.

The textile, which must be impregnated in the first bath prepared in step a), is advantageously, but not necessarily, washed beforehand in water in order to make it clean and in particular free from any alkaline or other chemical residues coming from a possible prior treatment. The pH of the water used for this prewashing is advantageously between 6 and 7, which can be finely adjusted by adding an acid, for example an organic acid, such as citric acid.

The "undried" impregnated fabric obtained in step b), which is generally in a continuous rotating movement, can be left on hold for a period that can vary between about 2 hours and 24 hours, before performing the next step. This pad/batch process is advantageous, but is not mandatory. It is also possible to dry and polymerise directly after impregnation as described hereinbelow.

After the textile has been impregnated by the bath prepared in step a), as indicated previously, the impregnated textile is then subjected to a high oven temperature, typically greater than or equal to 130° C., advantageously to a temperature between 150 and 160° C. The upper limit is fixed at an oven temperature of about 200° C. and preferably 165° C. The temperatures measured on the textile are preferably between 145 and 154° C. These embodiments promote polymerisation, and therefore the fixation of the fireproofed coating on the textile and consequently the resistance to washing thereof.

The drying in step c), during which the above-mentioned polymerisation reaction occurs, is conducted over a period of time that is as short as possible, for obvious reasons of efficiency of the entire fireproofing treatment process. However, drying is considered to be satisfactory when the relative moisture content of the dried textile, upon exiting the oven, is between 0% and 5% by weight, with this rate preferably being 0% by weight. The polymer thus formed, which is already polymerised around and in the textile fibres, is then subjected to oxidation in the second bath, preferably by increasing the pH, to a value between 8 and 10 and by means of the oxidising compound or compounds.

It is preferred to carry out this oxidation reaction by increasing the pH, by immersion of the textile comprising the polymer in an alkaline bath comprising an aqueous solution of alkali metal hydroxide, such as sodium hydroxide. Under these conditions, the oxidation reaction is relatively slow and is accelerated by means of an effective quantity of the oxidising compound or compounds, which will preferably be hydrogen peroxide. The quantity of hydrogen peroxide can vary in substantial proportions according to the quantity of polymer to be oxidised and the pH value.

In this alkaline bath, it is appropriate to proceed with the elimination, entirely or in part, of the by-products of the oxidation reaction of the polymer. For example, when the polymer results from the reaction between a THPx and the urea, the oxidation reaction leads to the formation of aldehyde, in particular formaldehyde, which must be eliminated because of the toxicity thereof, as indicated previously. To do this, the cross-linking mixture of diacetone acrylamide and at least one organic acid dihydrazide preferably selected from among the dihydrazides of adipic acid, sebacic acid, succinic acid and isophthalic acid, is also used as a "chemical scavenger" of aldehyde. There is therefore a dual effect, i.e., that of improving, by cross-linking, the resistance to washing of the fireproofed textile and of preventing the spread of harmful substances into the environment.

According to another embodiment, the adipic acid dihydrazide and the diacetone acrylamide are present in the second bath in a weight concentration ratio of 1, and preferably each at a concentration of 0.5% by bath weight.

Finally, the textile thus treated is then subjected to several washings, in order to eliminate the fireproofing treatment residues. The washing is advantageously carried out at a temperature between 25° C. and 75° C., for example at around 60° C., with water brought to a pH greater than or equal to 7, in order to eliminate any product that has not reacted. In this way, a base is advantageously added to the washing water, such as an alkaline hydroxide, for example, and preferably sodium hydroxide. A soap can also be added to the washing water.

The final washings are carried out in pure water in order to bring the pH of the final washing water back to a pH value close to or greater than 7. If it is necessary in order to adjust the pH value to a value close to, or greater than 7, an acid can be added, for example a weak acid, such as citric acid or maleic acid. Likewise, the washing water can also include, where applicable, one or several textile softeners, such as those indicated previously, for example.

After the washings, the fireproofed textile is recovered and dried according to the normal drying methods. The textile can then be subjected to one or more routine post-treatments intended for textiles that are well known to those skilled in the art, non-limitatively chosen from among an antimicrobial treatment, water-repellent treatment, oil-repellent treatment, coating and others.

The fireproofed textiles obtained by the method according to the invention can then be cut, sewn and more generally be used for making and manufacturing any element having a textile base, such as protective clothing, wall hangings, technical textiles, mattress ticking, upholstery fabrics, tent canvasses, and others.

The method of this invention, as described hereinabove, has many advantages in relation to fireproofing treatments known in the prior art, and among them, that of the excellent washproofness of the fireproofed textiles, thereby enabling the impregnation rate thereof to be reduced, which is beneficial for the feel (to one's hand) and therefore for the comfort of the user, and/or to extend the fireproofed nature of same and therefore the lifespan thereof. Moreover, the textiles obtained by the method according to the invention comply with human-ecological standards such as Okeo-Tex 100 Class 1.

This invention is now shown by means of the following examples, which do not present any objective of limitation with regards to the scope of this invention, a scope which is moreover defined by the appended claims. These examples show, in particular, the action of certain parameters of the method according to the invention on the polymerisation (therefore the fixation) of the fireproofed coating on the fibres, which, along with the oxidation of the polymer, promotes the resistance to washing and lifespan of the fireproofed textiles.

Example 1

The influence of the various compositions of the oxidation bath (1.0 to 1.18) on the resistance to washing as well as on the free formaldehyde content of the fireproofed textiles can be seen in table 1 hereinbelow.

If 1.8 (use of ethylene urea as an aldehyde scavenger) is compared with 1.18 according to the invention (diacetone acrylamide/adipic acid dihydrazide mixture instead of the ethylene urea), it is observed that, although these two compositions are otherwise very similar, composition 1.18 gives rise to fireproofed coatings that have both a free formaldehyde content that is clearly lower (165 compared to 253 ppm) and a higher weight per unit area (303 compared to 291 g/m2) after oxidation and one washing. Selecting a diacetone acrylamide/dihydrazide mixture instead of a conventional aldehyde scavenger therefore makes it possible to achieve an optimum in terms of human-ecological compatibility and resistance to washing.

TABLE 2

| Ref. sample | Weight in g: Before washing | Weight in g: After washings | Weight loss after 50 washings % | Flammability test |
|---|---|---|---|---|
| 2.1 | 843.5 | 839.1 | 0.5 | passed |
| 2.2 | 876.3 | 868.5 | 0.9 | passed |
| 2.3 | 309.0 | 288.5 | 6.6 | failed |
| 2.4 | 305.6 | 288.7 | 5.5 | failed |

TABLE 1

| Composition | 1.0 (without additive) | 1.1 | 1.2 | 1.3 | 1.4 | 1.5 | 1.6 | 1.7 | 1.8 | 1.9 | 1.10 | 1.11 | 1.12/1.14 | 1.13 | 1.15 | 1.16 | 1.17 | 1.18 |
|---|---|---|---|---|---|---|---|---|---|---|---|---|---|---|---|---|---|---|
| $H_2O_2$ g/l | 60 | 60 | 60 | 60 | 60 | 60 | 50 | 50 | 50 | 50 | 50 | 50 | 60 | 60 | 60 | 60 | 60 | 60 |
| Prestogene g/l | 10 | 10 | 10 | 10 | 10 | 10 | 10 | 10 | 10 | 10 | 10 | 10 | 10 | 10 | 10 | 10 | 10 | 10 |
| TEA g/l | 70 | 70 | 70 | 70 | 70 | 70 | 50 | 50 | 50 | 50 | 50 | 50 | 50 | 50 | 50 | 50 | 50 | 50 |
| Urea g/l | 100 | 100 | 100 | 100 | 100 | 100 | 50 | — | 50 | 50 | 50 | 50 | 50 | 50 | 50 | 50 | 50 | 50 |
| NaOH g/l | 30 | 30 | 30 | 30 | 30 | 30 | pH 10 | pH 10 | pH 10 | pH 10 | pH 10 | pH 10 | pH 10 | pH 10 | pH 10 | pH 10 | pH 10 | pH 10 |
| DAP g/l | — | 20 | — | 10 | — | 10 | — | 10 | — | — | 10 | — | — | — | — | — | — | |
| MAP g/l | — | — | — | — | — | — | — | — | — | — | — | 10 | — | 10 | — | — | — | |
| Ethylene urea g/l | — | — | 10 | 10 | — | — | — | — | 10 | — | 10 | — | 10 | 10 | 10 | 10 | 10 | — |
| Adipic acid dihydrazide g/l | — | — | — | — | 10 | 10 | — | — | — | 10 | — | 10 | 10 | 10 | 10 | 10 | 10 | 10 |
| Diacetone acrylamide g/l | — | — | — | — | — | — | — | — | — | — | — | — | 10 | — | — | — | — | 10 |
| $NH_4Cl$ g/l | — | — | — | — | — | — | — | — | — | — | — | — | — | — | 10 | — | — | — |
| Bicarbonate g/l | — | — | — | — | — | — | — | — | — | — | — | — | — | — | — | 10 | | — |
| $(NH4)_2SO_4$ g/l | — | — | — | — | — | — | — | — | — | — | — | — | — | — | — | — | 10 | — |
| SODA ASH g/l | — | — | — | — | — | — | — | — | — | — | — | — | — | — | — | — | — | 15 |
| Weight after oxidation and one washing g/m$^2$ | 305 | 284 | 288 | 293 | 300 | 296 | 292 | 297 | 291 | 295 | 290 | 299 | 304 (12) 296 (14) | 309 | 298 | 294 | 299 | 303 |
| Odour | ok | $NH_3$ | ok | $NH_3$ | ok | $NH_3$ | ok | $NH_3$ | ok | ok | ok | $NH_3$ | after 10' $NH_3$ | $NH_3$ | $NH_3$ | ok | $NH_3$* | ok |
| Free formaldehyde, ppm | 640 | 320 | 238 | 302 | 320 | 338 | 248 | 296 | 253 | 242 | 239 | 262 | | 212 | | | | 165 |

*Strong odour of ammonia

Table 2 hereinbelow makes it possible to compare the resistance to washing (50 washings) of textiles made of 50/50 cotton/polyester fireproofed according to the invention by means of an adipic acid dihydrazide/diacetone acrylamide mixture (samples 2.1 and 2.2 hereinafter) with that obtained without using this mixture (2.3 and 2.4). The results of limited flame propagation tests according to standard EN ISO 15025 are also included therein.

The favourable effect of the adipic acid dihydrazide/diacetone acrylamide mixture on the fire resistance of the textiles is clearly demonstrated here.

Example 3

Effect of the oven temperature on the washproofness of textiles (therefore on their flammability) and on the feel thereof.

The results of tests carried out on 8 polyester/cotton samples are compiled in table 3 hereinbelow. Optimal results from the standpoint of resistance to washing and feel are obtained for oven temperatures between 150 and 160° C.

TABLE 3

| No. | Dry weight (g) | Weight after padding (g) | Impregnation (g) | Weight after fixation (g) | Oven temperature (° C.) | Add on (g) | Fixation/feel | Weight loss after washing (%) |
|---|---|---|---|---|---|---|---|---|
| 3.1 | 71.13 | 144.07 | 102.5 | 110.30 | 120 | 35.5 | No fixation | 32.0 |
| 3.2 | 78.05 | 145.56 | 86.5 | 108.19 | 130 | 27.8 | Slight fixation | 17.0 |
| 3.3 | 75.60 | 148.62 | 96.75 | 108.06 | 140 | 30.0 | Fixation | 5.6 |
| 3.4 | 71.38 | 144.32 | 102.2 | 104.31 | 150 | 31.5 | Fixation | 0.9 |
| 3.5 | 73.20 | 150.53 | 105.64 | 107.61 | 160 | 31.9 | Fixation/hard to the touch | 0.8 |
| 3.6 | 73.22 | 153.06 | 104.80 | 108.30 | 170 | 32.4 | Fixation/hard to the touch | 0.8 |
| 3.7 | 75.10 | 152.55 | 103.12 | 107.87 | 180 | 30.2 | Fixation/hard to the touch | 0.8 |
| 3.8 | 77.38 | 151.23 | 95.43 | 111.30 | 190 | 30.5 | Fixation/hard to the touch | 0.9 |

Example 4

Effect of the temperature measured on the textile and the relative humidity (RH) thereof, upon exiting the oven, on the resistance to washing of textiles and on the flammability thereof.

The results of the flame resistance tests (FR) carried out on 9 polyester/cotton samples performed according to standard EN 531-532 are compiled in table 4 hereinbelow, after 50 washings according to ISO 1715797. The temperature T of the samples is measured by means of thermostrips.

TABLE 4

| Sample no. | RH (%) | Residence time in the oven(s) | T (°C.) | FR test |
|---|---|---|---|---|
| 4.1 | 35 | 30 | <116 | failed |
| 4.2 | 30 | 35 | <116 | failed |
| 4.3 | 20 | 40 | <116 | failed |
| 4.4 | 20 | 45 | 127 | failed |
| 4.5 | 10 | 50 | 143 | failed |
| 4.6 | 0-5 | 55 | 149 | passed |
| 4.7 | 0 | 60 | 149 | passed |
| 4.8 | 0 | 65 | 154 | passed |
| 4.9 | 0 | 70 | 154 | passed |

The fireproofed coating of samples 4.1 to 4.3. disappears entirely when washed. Samples 4.4 and 4.5 are partially polymerised.

Starting with 4.6 the polymerisation is complete, thereby providing satisfactory flame resistance tests. Optimum values for temperature and relative humidity of the textile are from 149 to 154° C. and 0%, respectively.

The invention claimed is:

1. A fireproofing treatment method for textiles, the method comprising:

a) preparing a first bath comprising a composition having two components A and B, with component A comprising at least one phosphorous compound and component B comprising urea and at least one pH buffer, the first bath having a pH of between 3.5 and 6;

b) impregnating a textile to be treated in the first bath;

c) heat-drying of the impregnated textile at a temperature between 130° C. and 165° C., during which drying a polymerisation reaction of the urea of component B and the phosphorous compound of component A occurs to produce a polymer;

d) oxidizing the polymer in a second bath, wherein the second bath includes at least one oxidising compound, and a mixture of diacetone acrylamide and at least one organic acid dihydrazide; and e) washing in water and drying of the treated textile.

2. The method according to claim 1, wherein component A comprises one or more phosphorous compounds including a tetrakis(hydroxymethyl)phosphonium salt.

3. The method according to claim 1, wherein the organic acid dihydrazide or dihydrazides are selected from among the dihydrazides of adipic acid, sebacic acid, succinic acid and isophthalic acid.

4. The method according to claim 3, wherein the adipic acid dihydrazide and the diacetone acrylamide are present in the second bath in a weight concentration ratio of 1.

5. The method according to claim 4, wherein the adipic acid dihydrazide and the diacetone acrylamide are each present in the second bath at a concentration of 0.5% by bath weight.

6. The method according to claim 1, wherein component B farther includes one or more oxidising agents.

7. The method according to claim 6, wherein the oxidising agent is 3-nitrobenzene sulfonate.

8. The method according to claim 1, wherein preparing the first bath includes adding a softening agent thereto.

9. The method according to claim 8, wherein the softening agent includes a polysiloxane.

10. The method according to claim 9, wherein the polysiloxane is hydrophilic.

11. The method according to claim 1, wherein the drying step c) is carried out at a temperature between 150° C. and 160° C.

12. The method according to claim 1, wherein the oxidizing step d) includes increasing the pH to a value between 8 and 10.

13. The method according to claim 12, wherein the at least one oxidising compound includes hydrogen peroxide.

* * * * *